US005100472A

United States Patent [19]

Fugitt et al.

[11] Patent Number: 5,100,472

[45] Date of Patent: Mar. 31, 1992

[54] DEIONIZED CLAY AND PAPER COATINGS CONTAINING THE SAME

[75] Inventors: Gary P. Fugitt, Chillicothe, Ohio; Michael J. Whalen-Shaw, Circleville; Dale B. Uhrig, Chillicothe, all of Ohio; Dene H. Taylor, Holyoke, Mass.

[73] Assignee: The Mead Corporation, Dayton, Ohio

[21] Appl. No.: 675,015

[22] Filed: Mar. 22, 1991

Related U.S. Application Data

[63] Continuation-in-part of Ser. No. 495,547, Mar. 19, 1990, abandoned, which is a continuation-in-part of Ser. No. 258,302, Oct. 14, 1988, abandoned.

[51] Int. Cl.[5] ..... C04B 14/04

[52] U.S. Cl. ..... 106/486; 162/181.8; 106/468; 501/149

[58] Field of Search ..... 106/464, 465, 468, 486, 106/487; 162/781.7, 181.8; 501/144, 148, 149

[56] References Cited

U.S. PATENT DOCUMENTS 3,536,264 10/1970 Helton, Jr. et al. ..... 241/4
4,018,673 4/1977 Hughes et al. ..... 209/5

OTHER PUBLICATIONS

L. Jarenstrom et al., Tappi Coating Conference Proceedings, pp. 1-10.

I. Melton and B. Rand, J. Colloid and Interface Science 60, 2, pp. 308-336 (1977).

*Primary Examiner*—William R. Dixon, Jr.
*Assistant Examiner*—Chris Gallo
*Attorney, Agent, or Firm*—Thompson, Hine and Flory

[57] ABSTRACT

Paper coatings composition containing highly deionized clay or calcium carbonate are disclosed; the compositions provide equivalent rheology at up to 4% higher solids; the compositions provide enhanced glossability; the highly deionized clay and calcium carbonate are also disclosed.

23 Claims, No Drawings

DEIONIZED CLAY AND PAPER COATINGS CONTAINING THE SAME

CROSS-REFERENCE TO RELATED APPLICATION

This is a continuation-in-part of co-pending application Ser. No. 07/495,547 filed Mar. 19, 1990, abandoned is a continuation-in-part of U.S. application Ser. No. 258,302, filed Oct. 14, 1988, now abandoned.

BACKGROUND OF THE INVENTION

The present invention relates to a paper coating composition which exhibits improved rheology and which is capable of providing higher gloss. The compositions of the present invention are characterized in that they are prepared using a deionized clay and/or deionized calcium carbonate and other low ionic strength components.

Paper coating compositions are widely used in the paper industry to provide high grade printing surfaces. Among the compositions which have been used are compositions comprised essentially of a major proportion of a mineral or organic pigment and a minor proportion of a binder in the form of a latex of a film-forming polymer. Suitable pigments have included finely divided clay, calcium sulfoaluminate also known as satin white, oxides of titanium, aluminum, silicon and zinc, calcium carbonate and microsized particles of high softening point polymers which are insoluble in the binder. Suitable binder polymers have been those which are film-forming at ambient and higher temperatures. The coating is spread over the paper surface by a roll coater, trailing blade, air knife, brush or other known means, after which it is dried and calendered.

SUMMARY OF THE INVENTION

The invention is a low ionic strength kaolin clay or ground calcium carbonate pigment that has been highly washed to remove free salt, coatings containing these pigments, and coating compositions containing the same. The resulting low ionic strength pigment slurry has a reduced degree of flocculation, smaller median particle size and increased colloidal stability of the particles. The low ionic strength pigment slurries have substantially improved rheology.

Coatings containing only low ionic strength pigments and coatings using low ionic strength pigments as a substantial component of the pigment portion (i.e., greater than 30% based on pigment) display unique properties. Compared to analogous compositions that do not contain low ionic strength pigments, the coatings of the present invention have substantially reduced viscosities that give them similar rheological properties at 3 to 4% higher solids. Compared to analogous compositions that do not contain low ionic strength pigments, the coatings of the present invention when applied to paper have substantially higher sheet gloss and porosity.

It has been found that coating compositions having improved rheology and glossability can be obtained by using a deionized clay or calcium carbonate in the coating composition. The term "deionized" refers to a low ionic strength clay or calcium carbonate which has been treated to remove at least a portion of the ions it contains. The clay or calcium carbonate starting material from which the ions are removed is herein referred to as "untreated". It is important to emphasize that in this context commercially available clays are considered untreated. Typically the materials of the present invention are deionized by the use of an ion exchange resin or by multiple washes with deionized or distilled water.

It is well known that clay particle size distribution, shape, and state of aggregation have a major effect on the performance of a paper coating composition. It was in an effort to understand more fully the effect of the state of clay aggregation on paper coatings that the present invention was discovered. This work involved an analysis of the particle size distribution of the clay and required that very dilute slurries (7% solids) of clays be prepared (more concentrated slurries could not be analyzed). In order to determine whether the method of dilution from normal shipping solids of 70% to the measurement solids of 7% affected the particle size of the clay, samples were prepared which had been diluted with deionized water or with the supernatant from the suspended clay. This lead to the discovery that the particle size distribution of a clay diluted with deionized water was substantially different than that of a clay diluted with its original suspending liquid (supernatant) containing all the salts and dispersants present in the clay as supplied by the manufacturer. Clays diluted with deionized water had a much higher population of smaller particles, a narrower particle size distribution and greater colloidal stability.

Part of the effect of deionizing the clay is to eliminate or reduce flocculation and thereby reduce particle size, however, it is only part of the effect. When coatings are prepared from clays having comparable particle size which are not deionized, gloss is not as high as it is for the paper coatings of the present invention and rheology is not as good. In addition reducing particle size often decreases opacity and brightness and increases viscosity; this does not occur in the coating compositions of the present invention. Viscosity decreases and in many cases no decrease in opacity or brightness is observed.

The low ionic strength clay of the present invention is a kaolin clay slurry which has been highly washed to give it substantially lower dissolved salt content than a conventional clay. Slurries of this clay range from about 60 to 75% solids with a preferred range of about 70 to 72%. Clay slurries in accordance with this invention are characterized by conductivities less than 1500 micromhos at 70% solids and more preferably conductivities less than 1300 micromhos at 70% solids. The conventional analog to this clay slurry has a conductivity of greater than 3000 micromhos at 70% solids. The low ionic strength of the liquid phase gives the clay slurry unique properties. The particles have a higher degree of colloidal stability as measured by their zeta potential. This increase in zeta potential causes aggregates that exist in the parent clay slurry to dissociate, resulting in a more monodispersed system of particles with a substantially reduced median particle size. The low ionic strength clay slurry has improved rheology as shown by substantially reduced high shear viscosity and dilatancy. The improved rheology allows a low ionic strength clay slurry to contain about 2% higher solids than its conventional counterpart but have comparable rheology. A dried clay made from the slurry is included in this invention.

The low ionic strength ground calcium carbonate of the present invention has been highly washed to give it substantially lower dissolved salt content than a conventional ground calcium carbonate slurry. Slurries of this material contain 70 to 80% solids with the preferred range being 75 to 80% solids. Calcium carbonate slurries in accordance with the invention are characterized by conductivities less than 700 micromhos at 70% solids and preferably less than 500 micromhos. The low ionic strength of the liquid phase gives the ground calcium carbonate slurry unique properties. The particles have a higher degree of colloidal stability as measured by zeta potential. This increase in zeta potential causes aggregates that exist in the parent calcium carbonate slurry to dissociate, resulting in a more monodispersed system of particles with a substantially reduced median particle size. The low ionic strength ground calcium carbonate slurry has improved rheology as shown by substantially reduced high shear viscosity and dilatancy. The improved rheology allows a low ionic strength ground calcium carbonate slurry to contain 1 to 2% higher solids than its conventional counterpart but have comparable rheology. A dried calcium carbonate made from the slurry is included in this invention.

The coating compositions of the present invention are advantageous because for comparable clay or calcium carbonate concentrations, they provided higher gloss and they can be used at higher solids. When applied to optically flat black glass plates, which are used as an ideal substrate to reflect the properties of a pigment or a coating without interference from surface roughness, up to a 20 point improvement in gloss was obtained On paper, not only can higher gloss be achieved, but comparable gloss levels can be obtained with less calendering.

Accordingly, the present invention provides a coating composition which, in its simplest form comprises deionized clay or deionized calcium carbonate and a latex. The compositions of the present invention will also generally include those additives commonly used in paper coatings such as dispersants, defoamers, pH modifiers, lubricants and other binders like starch.

In accordance with a preferred embodiment of the invention the deionized clay or deionized calcium carbonate is used in combination with a latex having a low ionic strength Such latexes can be manufactured to have low salt and free surfactant content, or can be prepared by treating commercially available latexes with an ion exchange resin to remove ions therefrom.

The present invention also provides slurries of deionized clays and deionized calcium carbonates and the deionized clays and calcium carbonate itself.

DETAILED DESCRIPTION OF THE INVENTION

Clays may be provided as calcined, non-calcined, predispersed, non-predispersed or physically delaminated clays. Representative clays for use in the present invention include Ultragloss 90 and Ultrawhite 90 sold by Engelhard Minerals & Chemicals Corporation, Edison, N.J. 08817; Hydragloss 90, Hydratex, and Hydrafine sold by J. M. Huber Corporation, Menlo Park, N.J. 08837; and Nuclay, and Lustra Clay sold by Freeport Kaolin Company, a division of Freeport Sulphur Company, New York, N.Y. 10017. No. 1, No. 2 and fine and delaminated clays may be used.

Other conventional pigments can also be employed along with the paper coating clay. These include titanium dioxide, talc, Satin White, hydrated alumina commonly employed as an extender for titanium dioxide, and calcium carbonate (which is preferably deionized). These pigments are used in amounts up to 30% by weight.

These clays and calcium carbonate may be deionized by suspending a normal process clay filtercake or calcium carbonate in deionized water, filtering the suspension, followed by 0-3 repetitions of the suspension-filtration process and finally deflocculation with about 0.3% sodium polyacrylate having a molecular weight between 1000 and 5000. Alternatively other traditional dispersants can be used. It is anticipated that other techniques for deionization will also be useful.

The clays and calcium carbonate can also be deionized by preparing a slurry of the clay, water and an ion exchange resin and screening out the ion exchange resin after the clay is deionized. This is shown in Example 4.

About 7 parts by weight water per 3 parts clay or calcium carbonate are used. Washing is typically conducted at room temperatures but higher or lower temperatures are also effective. Washing is continued until the desired level of deionization is achieved.

The deionized clays are characterized by both the median particle size, modal particle size, and the size distribution. These measurements are made by sedimentation and expressed as a mass distribution using the Sedigraph 5100 particle sizer. Samples are diluted to test solids of 7% using their own supernatant. Further, deionized clays are defined by changes in particle size and distribution relative to the non-deionized clays. Typical results are shown in Table 1.

TABLE 1

| | Typical Change in Clay Particle Size Due to Deionization | | | |
|---|---|---|---|---|
| | #1 Clay | #2 Clay | Fine Clay | Delaminated Clay |
| Median Particle Size Microns | | | | |
| Nondeionized | 1.15 | 1.10 | 0.56 | 1.55 |
| Deionized | 0.38 | 0.45 | 0.26 | 0.60 |
| Percent Reduction | 67 | 53 | 54 | 60 |
| Percent Less than 0.5 Microns | | | | |
| Nondeionized | 17 | 15 | 45 | 9 |
| Deionized | 60 | 54 | 75 | 45 |
| Percent Increase | 253 | 260 | 67 | 400 |

The latexes used in the present invention may also be selected from among those latexes commonly used in this art. Particularly preferred are the resins which exhibit primarily elastomeric properties, often described as the rubbery polymers, such as the copolymers styrene-butadiene and styrene-isoprene, or either of them slightly carboxylated by incorporation of from 3 to 10% acrylic acid. Suitable commercial examples are the latexes sold by Dow Chemical Company No. 316, 620, and 640. More generally, the latexes may be latexes of homopolymers or copolymers of $C_4$–$C_{10}$ dienes such as butadiene, 2-methylbutadiene, pentadiene-1.3, etc. The copolymers may be copolymers of vinyl monomers such as styrene, acrylic acid and its esters, methacrylic acid and its esters, nitriles and amides. If desired, rubbery polymer latices may be blended with minor proportions of latices of hard or resinous polymers having a high MFT such as polystyrene, polyacrylonitrile, polymethyl methacrylate, copolymers of the monomers of these resinous polymers such as styrene-acrylonitrile resins and resinous copolymers of these monomers with other copolymerizable monomers such as copolymers of styrene with butadiene in which styrene forms more than 70 weight % of the polymer. Preferred are latices in which the copolymer is composed of about 0–60 weight % of a $C_4$–$C_6$ conjugated diolefin, 40 to 99% of a styrene and 0.1–5% of a polymerizable unsaturated monomer having a polar group such as a carboxyl group in its structure. The solid content of the latex is generally 20 to 55% by weight These latexes can be manufactured using additives which are designed to minimize ionic strength or they can be prepared by treating commercially available latexes to reduce their ionic strength.

A technique which may be used to deionize or reduce the ionic strength of a commercial latex involves diluting the latex to about 34% solids with deionized water and adding a mixed anionic and cationic ion exchange resin such as Dow MR3 or Rohm and Haas Amberlite 150 at a dry weight ratio between 0.1:1 and 2:1 to the latex. After about 1 to 2 hours the ion exchange resin can be strained from the latex It has been found the pH of the latex is preferably about 6.0 to 10.0.

Paper coating compositions in accordance with the invention may also contain a hydrocolloid. The hydrocolloid may be deionized as well. Conventional paper coating hydrocolloids may be used such as starch, polyvinyl alcohol, proteins.

The starch optionally used in the present invention may also be selected from those starches commonly used in this art. Suitable commercial examples include all commercial starches produced for the paper industry. These starches are preferably deionized by diluting to 5% with deionized water and filtering once or diluting to 10–20% and filtering 2 or 3 times. The slurry need only be mixed for 5–10 minutes before filtering or can be separated by gravity settling The starch or hydrocolloid has a preferred conductivity of less than 0.5 millimhos at 20% solids and 23° C.

Addition of 1–10% deionized starch to the deionized clay has been found to partially protect the clay from reflocculation by later additives.

The deionized clay may be treated with a dispersing agent to disperse the deionized clay in the latex Conventional non-ionic dispersing agents such as polyacrylates may be used for this purpose.

The compositions of the present invention may contain about 60 to 85% by weight pigment (of which 50 to 100% is deionized clay and/or calcium carbonate), about 1 to 40 and preferably 3 to 20% latex and about 0 to 5% of starch or other hydrocolloid. Clay and calcium carbonate are often used together in a ratio of clay to calcium carbonate of about 7:1 to 1:3.

In addition to the pigment and latex binder components, other usual and known additives may be included in the paper coating composition as required. Other binders, e.g., proteins, viscosity modifiers, e.g., sodium polyacrylates, defoamers, pH modifiers (preferred coatings have a pH of 6 to 10), lubricants, and other film-forming latices, etc. may be included.

Clay containing coating compositions in accordance with this invention (i.e., the combination of clay, latex, and any pigment, starch, or other additive) preferably have a conductivity less than 1.3 millimhos at 23° C. and 60% total solids. Calcium carbonate containing coating compositions preferably have a conductivity less than 0.8 millimhos at 23° C. and 60% solids.

Desirable properties are achieved when the latex and hydrocolloid as well as the clay and calcium carbonate are deionized. However, because deionization of the latex and hydrocolloid adds expense to the composition this may not always be desirable commercially. Accordingly, in the most typical embodiments of the invention the clay and calcium carbonate will be deionized, however, further improvements in rheology and gloss may be achieved if commercially desirable by deionizing the latex and hydrocolloid.

The compositions of the present invention can be applied to conventional base stocks using known paper coating techniques and optionally calendered. The compositions can be applied in conventional coat weights.

The present invention is illustrated in more detail by the following non-limiting examples.

EXAMPLE 1

Three samples of deionized clay were prepared.

Sample A was a regular #1 clay which was centrifuged then the sediment was resuspended in deionized water. The centrifugation-resuspension process was repeated twice. A polyacrylate dispersant was added to the resulting clay until minimum low shear viscosity was reached.

Sample B was prepared by triple washing a regular #1 clay with deionized water. A polyacrylate dispersant was added to the resulting clay until minimum low shear viscosity was reached.

Sample C was prepared by mixing a high brightness #1 clay with a mixed ion exchange resin at a 1:0.1 dry-on-dry ratio. The mixture was blended for 2 hours then screened through a 65 mesh screen to remove the beads. A polyacrylate dispersant was added to the resulting clay until minimum low shear viscosity was reached. The conductivity, Hercules and Brookfield viscosity of each clay is shown in Tables 2 and 3.

TABLE 2

| | Clay Sample A | | | | | |
|---|---|---|---|---|---|---|
| | Conductivity (millimhos) | | Hercules Visc. (1100 RPM) | | Brookfield Visc. (100 RPM) | |
| Solids | Regular | Deionized | Regular | Deionized | Regular | Deionized |
| 75.0 | 2.25 | .130 | 5457 | 2465 | 410 | 1360 |
| 74.5 | 2.25 | .122 | 3697 | 1200 | 363 | 960 |
| 74.0 | 2.25 | .122 | 3757 | 1118 | 292 | 798 |
| 73.5 | 2.25 | .122 | 2122 | 104 | 245 | 694 |
| 73.0 | 2.22 | .122 | 1592 | 83 | 217 | 592 |
| 72.5 | 2.22 | .122 | 1226 | 52 | 192 | 482 |
| 72.0 | 2.22 | .122 | 160 | 42 | 170 | 404 |
| 71.5 | 2.22 | .122 | 118 | 35 | 152 | 350 |
| 71.0 | 2.20 | .122 | 76 | 28 | 140 | 298 |
| 70.5 | 2.20 | .122 | 49 | 28 | 120 | 250 |
| 70.0 | 2.20 | .122 | 42 | 28 | 109 | 222 |

This example clearly shows that deionized clay has greatly reduced high shear viscosity and this difference is increased as solids level is raised. Since high shear viscosity is the parameter most important to pumpability of a slurry, the deionized clay can be shipped and handled at 2% higher solids without detrimentally affecting the pumpability.

TABLE 3

| | Clay Sample B | | Clay Sample C | |
|---|---|---|---|---|
| | Undeionized | Deionized | Undeionized | Deionized |
| Solids | 70.1 | 70.1 | 70.0 | 70.0 |
| Conductivity | 1.65 | 0.61 | 1.41 | 0.59 |
| Brookfield Viscosity (100 RPM) | 146 | 268 | 106 | 188 |
| Hercules Viscosity (1100 RPM and ABOB) | 278 | 222 | 3016 | 1140 |

The results in Table 2 and 3 clearly show that high shear viscosity is reduced by deionizing a clay whether the clay is deionized by multiple centrifugation and resuspension, multiple washing, or by use of an ion exchange resin.

EXAMPLE 2

Clay

Hydrafine clay, a No. 1 kaolin clay from J. M. Huber Corporation, was deionized by washing twice with deionized water.

Latex

Dow RAP316 latex (a styrene butadiene latex available from Dow Chemical Company) was diluted to 34% solids and blended with an ion exchange resin (Dow MR3, a mixed cationic and anionic resin available from Dow Chemical Company) in a dry weight ratio of 1:1. The mixture was mixed for 4 hours and filtered through a 65 mesh screen, to remove the ion exchange resin. The resulting latex contained 30% solids and the pH was adjusted to 8.5 with ammonia.

Starch

Coating compositions were prepared by preparing a clay suspension containing 74% solids and blending this with the starch before the latex addition to provide the coating compositions shown in Table 4:

TABLE 4

| | Sample No. (wt. %) | |
|---|---|---|
| | 1 Control | 2 Invention |
| Clay (Hydrofine) | 87 | — |
| Deionized Clay (Hydrofine) | — | 87 |
| Latex (Dow RAP 316) | 10 | 5 |
| Deionized Latex (Dow RAP 316) | — | 5 |
| Starch (PG 250) | 3 | 3 |
| Solids | 61.4 | 61.4 |

The conductivity of each coating was measured using a YSI Model 32 conductance meter having a range of 0.01 to 20,000 microohms. All testing was done at room temperature. The coatings were drawn down on an optically smooth black glass to measure the optical properties. Gloss was measured using a Hunter 75 degree gloss meter.

The results obtained are provided in Table 5.

TABLE 5

| | Sample # | |
|---|---|---|
| | 1 | 2 |
| Conductivity | 1.97 | 1.26 |
| Brookfield Viscosity | 960 | 830 |
| Hercules Viscosity | 43.8 | 36.8 |
| Gloss | 36.2 | 46.0 |

The forgoing results clearly show that the paper coating compositions of the present invention prepared with deionized clay and deionized latex and deionized starch exhibit higher gloss and better rheology than coatings prepared without deionizing the clay and latex. The deionized coating can be prepared at 4% higher solids and maintain equal or better rheology.

EXAMPLE 3

The coatings described in Example 3 were applied to paper using a rigid blade coater. The rawstock was a wood-free sheet, and the coater speed was 2000 feet per minute. A precoat made up of a 50:50 blend of #2 clay and coarse calcium carbonate was used. The resulting calendered and uncalendered glosses are recorded in Table 6.

TABLE 6

| | Uncalendered | Calendered |
|---|---|---|
| Control | | |
| As 8 lb/rm single coat | 21.3 | 57.0 |
| As 6 lb/rm topcoat | 27.1 | 63.8 |
| Sample #1 | | |
| As 8 lb/rm single coat | 25.3 | 60.4 |
| As 6 lb/rm topcoat | 35.5 | 69.8 |
| Sample #2 | | |
| As 8 lb/rm single coat | 30.0 | 65.0 |
| As 6 lb/rm topcoat | 42.8 | 73.3 |

It can clearly be seen from these results that a deionized coating (Sample #2) gives an increase from 3–8 points of gloss when applied to uncoated or precoated paper.

EXAMPLE 4

In the lab, 2000 g of a commercial spray dried #1 clay was added to 857 grams of distilled water and mixed on a Cowles mixer for 10 minutes. The resulting 70% solids slurry was blended in a high speed blender for 2 minutes. A second batch of slurry was made in an identical manner.

The first batch was diluted to 40% solids while under a mixer and 200 g of a mixed cationic and anionic ion exchange resin was added. The clay and resin were mixed for 2 hours. After this time, the mixture was poured through a 100 mesh 5 screen to remove the resin. A polyacrylate dispersant was added to the resulting slurry at a level of 0.3% based on dry clay. About half of the resulting dispersed deionized clay slurry was dried and added back to the remaining slurry to create a 73% solids deionized clay slurry. This slurry was used for comparison to the second batch of 70% #1 clay slurry.

Two ground calcium carbonate slurries (90% less than 2 microns) were made at 76% solids using the method described above. One of the slurries was diluted to 50% and the same ion exchange resin was added on a 1:10 basis dry resin:dry carbonate. After 2 hours of mixing, the slurry was screened to remove the resin. A polyacrylate dispersant was added at 0.015% based on dry carbonate.

A portion of the resulting dispersed deionized calcium carbonate slurry was dried and added back to the remaining slurry to produce a 78% solids deionized calcium carbonate slurry. This slurry was compared to the other 76% slurry of undeionized calcium carbonate.

These slurries were tested and the results are shown in Tables 7 and 8. Particle size was measured using the Sedigraph Model 5100. Zeta potential was measured using a Lazer Z instrument. Samples for particle size and zeta potential measurement were diluted using their own supernatant. These results show that the deionized pigments have reduced high shear viscosity and can be increased in solids and have comparable rheology to the conventional pigment slurries. The reduction in particle size indicates deflocculation of the pigment slurries. This deflocculation is due to the increase in colloidal stability indicated by the changes in zeta potential.

TABLE 7

Evaluation of Deionized and Conventional Clay and Calcium Carbonate Slurries

| | % Solids | Brookfield Low Shear Visc. (cP) (100 rpm) | Hercules Visc. (cP) High Sheer (A bob, 4000 rpm) | Conductivity (micromhos) |
|---|---|---|---|---|
| Commercial #1 Clay | 70.1 | 153 | 198 | 1650 |
| Deionized #1 Clay | 70.0 | 222 | 43 | 650 |
| | 71.0 | 417 | 69 | 710 |
| | 72.0 | 539 | 198 | 750 |
| | 73.0 | 832 | 1018 | 830 |
| Ground Calcium Carbonate | 76.0 | 301 | 496 | 780 |
| Deionized Calcium Carbonate | 76.0 | 263 | 167 | 600 |
| | 77.0 | 359 | 465 | 630 |
| | 78.0 | 553 | 1043 | 650 |

TABLE 8

Evaluation of Deionized and Convention Clay and Calcium Carbonate Slurries

| | % Solids | Particle Size (u) (Modal) | Particle Size (u) (Median) | Zeta Potential (mV) |
|---|---|---|---|---|
| Commercial #1 Clay | 70.0 | 0.79 | 0.76 | −50.8 |
| Deionized #1 Clay | 70.0 | 0.37 | 0.42 | −63.3 |
| Ground Calcium Carbonate | 76.0 | 1.18 | 0.94 | −45.5 |
| Deionized Calcium Carbonate | 76.0 | 1.07 | 0.83 | −53.3 |

EXAMPLE 5

Deionized clay and calcium carbonate slurries were produced by the method described in Example 1. Deionized latex was produced by diluting a styrene-butadiene latex to 40% solids and adding an ion exchange resin to latex at a 1:10 ratio. This mixture was stirred for one hour and filtered through cheesecloth to remove the ion exchange resin. A deionized polystyrene 3 plastic pigment was produced by the same process. A deionized starch was produced by diluting an uncooked commercial ethylated starch to 5% solids with distilled water and then removing the water by filtration. The resulting deionized starch was cooked by conventional methods.

Five different coating formulations containing various combinations of clay, titanium dioxide, calcium carbonate, plastic pigment, latex and starch were made with deionized and convention components. These coatings were applied to optically smooth glass (an ideal substrate) and the gloss of the dried films was measured. The results in Tables 9 and 10 show that in all cases, the coatings containing deionized components had lower low shear viscosity and higher gloss than their conventional analogs. Generally, high shear viscosities were comparable. Coatings B, D, H and K show that coatings with pigment systems that are only partially deionized also show the described benefits.

TABLE 9

Evaluation of Deionized Coatings and Their Conventional Analogs Containing Pigment Blends

| | A | B | C | D | E | F |
|---|---|---|---|---|---|---|
| Commercial #1 Clay | 82 | | 62 | | 80 | |
| Deionized #1 Clay | | 82 | | 62 | | 80 |
| Titanium Dioxide | 5 | 5 | 25 | 25 | | |
| Plastic Pigment | | | | | 7 | |
| Deionized Plastic Pigment | | | | | | 7 |
| Styrene/Butadiene Latex | 10 | | 10 | | 10 | |
| Deionized Styrene/ Butadiene Latex | | 10 | | 10 | | 10 |
| Corn Starch | 3 | | 3 | | 3 | |
| Deionized Corn Starch | | 3 | | 3 | | 3 |
| Solids (%) | 60 | 60 | 60 | 60 | 60 | 60 |
| Conductivity (millimhos) | 1.88 | 0.82 | 2.18 | 1.02 | 2.13 | 0.56 |
| Brookfield Visc. (100 rpm) | 912 | 504 | 1000 | 665 | 824 | 335 |
| Hercules Visc. (E bob, 6000 rpm) | 31.3 | 32.7 | 28.9 | 59.1 | 33.3 | 26.2 |
| Coating Gloss (Ct Wt = 15 lb/rm) | 28.2 | 54.6 | 30.3 | 51.2 | 38.0 | 63.4 |

TABLE 10

| Evaluation of Deionized Coatings and Their Analogs Containing Calcium Carbonate | G | H | I | J | K | L |
|---|---|---|---|---|---|---|
| Commercial #1 Clay | 77 | | | 27 | | |
| Deionized #1 Clay | | 77 | 77 | | 27 | 27 |
| Ground Carbonate (90% < 2 u) | 10 | 10 | | 60 | 60 | |
| Deionized Ground Carbonate (90% < 2 u) | | | 10 | | | 60 |
| Styrene/Butadiene Latex | 10 | | | 10 | | |
| Deionized Styrene/ Butadiene Latex | | 10 | 10 | | 10 | 10 |
| Corn Starch | 3 | | | 3 | | |
| Deionized Corn Starch | | 3 | 3 | | 3 | 3 |
| Solids (%) | 60 | 60 | 60 | 60 | 60 | 60 |
| Conductivity (millimhos) | 2.05 | 0.85 | 0.74 | 1.08 | 0.77 | 0.59 |
| Brookfield Visc. (100 rpm) | 720 | 489 | 575 | 1174 | 691 | 424 |
| Hercules Visc. (E bob, 6000 rpm) | 33.4 | 38.3 | 36.9 | 31.2 | 45.4 | 37.7 |
| Coating Gloss Ct Wt = 15 lb/rm) | 29.1 | 47.0 | 44.3 | 18.6 | 28.5 | 36.0 |

EXAMPLE 6

A conventional clay based coating and its deionized analog were prepared using the formulations shown in Table 11. These two coatings were applied to a wood-free base sheet with a rigid blade at 1500 feet per minute on a high speed pilot coater. Sheets of the coated paper were supercalendered on a handsheet supercalender. The test results in Table 11 show that the deionized coating at 64% solids has higher shear viscosity equivalent to its convention analog at 60.5% solids. In addition, the supercalendered paper with the deionized coating has higher gloss with improved smoothness and porosity.

TABLE 11

| Comparison of a Deionized Clay Based Coating and Its Conventional Analog Values in the Table are percent of total dry weight (coat weight of about 9 lb/rm) | | |
|---|---|---|
| Commercial Fine Clay | 65 | |
| Deionized Commercial Fine Clay | | 65 |
| Commercial #2 Clay | 11 | |
| Deionized Commercial #2 Clay | | 11 |
| Titanium Dioxide | 4 | 4 |
| Plastic Pigment | 7 | |
| Deionized Plastic Pigment | | 7 |
| Styrene/Butadiene Latex | 12.7 | |
| Deionized Styrene/Butadiene Latex | | 12.7 |
| Polyvinyl Alcohol | 0.3 | 0.3 |
| Lubricant | 1.0 | 1.0 |
| Crosslinker | 0.15 | 0.15 |
| Coating Solids (%) | 60.6 | 64.2 |
| Conductivity (micromhos) | 2370 | 1060 |
| Brookfield Viscosity, 100 rpm (cP) | 688 | 2164 |
| Hercules Viscosity, E bob, 6000 rpm (cP) | 18.4 | 19.4 |
| Sheet Gloss | 68.9 | 73.1 |
| Smoothness (microns) (Parker Print Surf, 20 kg) | 1.04 | 0.76 |
| High Pressure Porosity (sec/100 cc) | 201.2 | 170.5 |

EXAMPLE 7

A conventional calcium carbonate based paper coating and its deionized analog were prepared using the formulations shown in Table 12. These two coatings were applied to a wood-free base sheet with a bent blade at 1500 feet per minute on a high speed pilot coater. Sheets of the coated paper were supercalendered on a handsheet supercalender. The test results in Table 12 show that the deionized coating at 69% solids has lower low shear viscosity and equivalent high shear viscosity to its conventional analog at 67% solids. In addition, the supercalendered coated sheet with the deionized coating has higher gloss.

TABLE 12

| Comparison of a Deionized Calcium Carbonate Based Coating and Its Conventional Analog Values in the Table are percent of total dry weight (coat weight of about 10 lb/rm) | | |
|---|---|---|
| Calcium Carbonate | 50 | |
| Deionized Calcium Carbonate | | 50 |
| Commercial #1 Clay | 25 | |
| Deionized Commercial #1 Clay | | 25 |
| Titanium Dioxide | 5 | 5 |
| Plastic Pigment | 7 | |
| Deionized Plastic Pigment | | 7 |
| Styrene/Butadiene Latex | 10 | |
| Deionized Styrene/Butadiene Latex | | 10 |
| Corn Starch | 3.0 | |
| Deionized Corn Starch | | 3.0 |
| Lubricant | 1.0 | 1.0 |
| Crosslinker | 0.25 | 0.25 |
| Solids (%) | 67 | 69 |
| Conductivity (micromhos) | 2170 | 650 |
| Brookfield Viscosity (100 rpm) | 2400 | 480 |
| Hercules Viscosity (E bob, 6000 rpm) | 46.0 | 48.7 |
| Sheet Gloss | 60.5 | 63.7 |

Having described the invention in detail and by reference to preferred embodiments thereof, it will be apparent that modifications and variations are possible without departing from the scope of the invention defined in the appended claims.

What is claimed is:

1. A paper coating composition comprising deionized clay and/or deionized calcium carbonate and a latex, said deionized clay being characterized by a conductivity less than about 1500 micromhos as a slurry of 70% solids and said calcium carbonate being characterized by a conductivity less than about 700 micromhos as a slurry of 70% solids.

2. The paper coating composition of claim 1 wherein said coating contains about 1 to 35% titanium dioxide as solids.

3. The paper coating composition of claim 1 wherein said composition contains said deionized clay.

4. The paper coating composition of claim 1 wherein said composition contains said deionized calcium carbonate.

5. The paper coating composition of claim 1 wherein said latex is deionized.

6. The paper coating of claim 1 containing a hydrocolloid.

7. The paper coating composition of claim 3 wherein said coating exhibits a conductivity less than about 1.3 millimhos when present in an amount of 60% by weight at 23° C.

8. The coating of claim 4 where conductivity is less than about 0.8 millimhos at 60% total solids and 23° C.

9. The paper coating composition of claim 6 wherein said hydrocolloid is characterized by a conductivity less than about 0.5 millimhos at 2% total solids and 23° C.

10. The paper coating composition of claim 1 wherein said latex is selected from the group consisting of a styrene-butadiene latex, an acrylic latex and a polyvinyl acetate latex.

11. The paper coating composition of claim 9 wherein said composition contains about 30 to 100% deionized clay or calcium carbonate based on total pigment present.

12. The paper coating composition of claim 10 wherein said composition contains about 10 to 40% latex based on total solids.

13. The paper coating composition of claim 6 wherein said composition contains 1 to 10% starch based on total solids.

14. The paper coating composition of claim 3 wherein said clay is a kaolin clay.

15. A slurry of deionized clay, said deionized clay being present in an amount of about 60 to 75%, said slurry being characterized by a conductivity of less than about 1500 micromhos at 70% solids.

16. A deionized clay obtained by drying the slurry of claim 15.

17. A slurry of deionized calcium carbonate containing about 70 to 80% deionized calcium carbonate, said slurry being characterized by a conductivity less than about 700 micromhos at 70% solids.

18. A deionized calcium carbonate obtained by drying the slurry of claim 17.

19. The paper coating composition of claim 1 wherein said clay is characterized by a conductivity less than about 1300 micromhos and said calcium carbonate is characterized by a conductivity less than about 700 micromhos.

20. The slurry of claim 15 wherein said slurry is characterized by a conductivity less than about 1300 micromhos.

21. The slurry of claim 17 wherein said slurry is characterized by a conductivity less than about 500 micromhos.

22. The paper coating composition of claim 1 wherein said coated clay is characterized by a conductivity less than about 100 micromhos.

23. The slurry of claim 15 wherein said slurry is characterized by a conductivity less than about 1000 micromhos.

* * * * *